US005515619A

United States Patent [19]

Kahl et al.

[11] Patent Number: 5,515,619

[45] Date of Patent: May 14, 1996

[54] FLEXIBLY MOUNTED SEALING STRIPS OF A VACUUM ROLL FOR A WEB DRYER

[75] Inventors: Peter Kahl, Heidenheim; Karl-Heinz Klein, Sontheim; Helmut Grimm, Ellwangen; Wolfgang Mueller, Giengen, all of Germany

[73] Assignee: J.M. Voith GmbH, Germany

[21] Appl. No.: 303,654

[22] Filed: Sep. 9, 1994

Related U.S. Application Data

[63] Continuation-in-part of Ser. No. 151,255, Nov. 12, 1993, which is a continuation-in-part of Ser. No. 102,766, Aug. 6, 1993, abandoned.

[30] Foreign Application Priority Data

Jun. 17, 1994 [EP] European Pat. Off. ..... 94109372

[51] Int. Cl.[6] ..... F26B 13/04

[52] U.S. Cl. ..... 34/114; 34/117

[58] Field of Search ..... 34/114, 117, 116, 34/120; 162/193, 207, 363–69

[56] References Cited

U.S. PATENT DOCUMENTS

| | | | |
|---|---|---|---|
| 4,553,340 | 11/1985 | Petersson | 34/116 |
| 4,757,619 | 7/1988 | Villalobos | 34/116 |
| 4,876,803 | 10/1989 | Wedel . | |
| 4,932,138 | 6/1990 | Liedes et al. | 162/370 |
| 5,068,980 | 12/1991 | Müller | 34/116 |
| 5,074,278 | 12/1991 | Turcotte | 34/116 |
| 5,163,236 | 11/1992 | Heikkilä | 34/117 |
| 5,214,861 | 6/1993 | Vuorinen | 34/117 |
| 5,379,526 | 1/1995 | Haverinen | 34/114 |

FOREIGN PATENT DOCUMENTS

| | | | |
|---|---|---|---|
| 2712184 | 9/1978 | Germany | 34/117 |
| 9403675 | 2/1994 | WIPO | 34/117 |

*Primary Examiner*—Henry A. Bennett
*Assistant Examiner*—Steve Gravini
*Attorney, Agent, or Firm*—Ostrolenk, Faber, Gerb & Soffen

[57] ABSTRACT

In a papermaking machine, the drying section includes a vacuum based system which serves to guide the web and supporting felt (15) from a first drying cylinder (11) to a transfer vacuum roller (10), which has perforations (13) through which a vacuum is communicated into the interior of the roller 10 from of an external suction box (14). The suction box (14) includes lengthwise extending sealing strips (28, 29) located adjacent and bounding the free circumferential surface of the transfer roller (10), which is not overlapped by the felt of the drying section. The sealing strips extend from the suction box 14 to the roller mantel (10*a*) of the roller 10. These strips are further designed in the style of a doctor blade and are flexibly mounted on the suction box (14) so that they are flexible and biased against the roller 10 by spring action. They extend approximately tangentially to the surface of the roller mantel (10*a*), contacting it gently.

27 Claims, 4 Drawing Sheets

FLEXIBLY MOUNTED SEALING STRIPS OF A VACUUM ROLL FOR A WEB DRYER

This is a continuation in part application of U.S. patent application Ser. No. 08/151,255, filed Nov. 12, 1993, which is in turn a continuation in part of abandoned U.S. patent application Ser. No. 08/102,766, filed Aug. 6, 1993.

BACKGROUND OF THE INVENTION

The invention relates to a drying section of a papermaking machine and more particularly to system for guiding a paper web to be dried, which travels together with a porous supporting felt between adjacent drying cylinders.

U.S. Pat. No. 4,677,762 discloses a guide or transfer roller that is provided with recesses and operates with an external vacuum box. The vacuum box is disposed to generate a vacuum along the inside of the felt to hold the web to be dried against the other side of the felt.

Patent publication WO 90/12151 discloses a guide box designed as a suction box. By means of a preferably mechanical air deflecting member, known per se from U.S. Pat. No. 4,856,205, the boundary air layer that would otherwise be carried by the felt into the pocket between the cylinders in the direction of the paper web transfer roller is deflected upward away from the pocket. Thereby the vacuum in the suction box can be kept low to save energy.

This known design provides an insufficient air seal into the pocket, so that some air is drawn between the outer wall of the suction box and the supporting felt as well as at the transfer roller, especially between the trailing gap and the suction chamber of the suction box. As a result, stagnant, ambient air is drawn in and the vacuum that is supposed to hold the paper web against the supporting felt is destroyed or rendered ineffective. Indeed, a positive pressure may even be generated.

In the system described in German publication DE-OS 4314475 for guiding a web to be dried, measures are taken to prevent the need from applying an internal vacuum at the interior of the transfer roller. Nevertheless, a powerful vacuum must still be generated in the circumferential grooves provided in the outer mantel of the roller by drawing a powerful vacuum from the external suction box.

To couple the vacuum box to the transfer roller two lengthwise sealing strips are provided. These sealing strips are mounted on the underside of the external suction box, each sealing strip projecting into the leading and trailing gaps, and nearly completely filling it. The strips also extend transversely with respect to the web travel direction over the entire length of the suction box.

Each of these two sealing strips, which are in the shape of relatively thick wedges, has a concave sealing surface that matches the arcuate shape of the roller mantel of the transfer roller. To avoid the risk that the sealing strips will exert a braking force on the rotating transfer roller, the lengthwise extending sealing strips must be installed at a considerable distance away from the transfer roller. The effect of the sealing strip is therefore partially lost. This risk also exists when the external suction box is not manufactured sufficiently precisely and/or when it flexes under its own weight or because of nonuniform heating.

SUMMARY OF THE INVENTION

The main object of the invention is to provide an improved system for guiding a paper web to be dried so that, compared to the prior art, the web to be dried is held more securely to the felt between drying section cylinders and as the web and felt travel around the transfer roller, with relatively minute expenditures of energy. In addition, at least one of the two gaps or spaces between the vacuum box and the felt is better sealed against the flow of air into the gap even when the external suction box is not manufactured precisely and/or when it flexes.

The present invention couples the vacuum in the vacuum box to the transfer roller by sealing means which are constructed similar to doctor blades. These strips are mounted so that they flex and are biased by spring action against the mantel of the transfer roller. Thereby, the portion of the transfer roller mantel that is not contacted by the supporting felt is sealed more effectively and simply, so that penetration of stagnant, ambient air is suppressed.

As a result, the removal of air by suction from around the transfer roller and/or the spaces between the box and the felt is carried out much more economically, i.e. using substantially less energy. The use of a doctor blade style sealing strip has the advantage that the sealing point can be located relatively very close to the point where the felt leaves and/or arrives at the transfer roller. Surprisingly, tests have shown that despite the contact between the sealing strips and the transfer roller, no signs of wear showed up anywhere on the sealing strips. This is true even for suction boxes with manufacturing dimensional inaccuracies and/or those which slightly sag or flex. Even when the suction box flexes, the sealing strips, mounted flexibly with spring action, always remain in soft contact with the transfer roller over their entire length, so that a sufficient sealing effect is always maintained.

The doctor blade style sealing strip of the present invention is preferably freely mounted and tensioned only at its ends, on one side for example by a screw and on the other side by a spring, so that the sealing blade can expand freely and vibrations are avoided.

The sealing blade can be made of plastic. It is a commercially available part and therefore simple to manufacture and to mount, similar to the lengthwise extending sealing strips known from the prior art. In order to achieve the best possible seal, preferably two lengthwise sealing strips according to the invention are provided, one at the leading gap, i.e. adjacent the point where the web and felt joint run arrives at the transfer roller, and the other at the trailing gap, i.e. near where the web and felt join run leaves the transfer roller.

As a result, a comparatively minute amount of energy is needed to create and maintain the vacuum inside the transfer roller. At the same time, only a slight vacuum develops along the straight path or space between the supporting felt and the vacuum box, which in most cases is sufficient. However, if and when one desires a relatively higher vacuum along one or both of the straight web/felt joint runs, the lengthwise sealing strip according to the invention can be eliminated from the gap in question (e.g. from one of the leading and trailing gaps), or the sealing strip can be replaced by a conventional felt sealing strip. The fact that the lengthwise sealing strip runs approximately tangentially to the roller mantel of the transfer roller means that the outside wall of the suction box and the outer surface of a lengthwise sealing strip together form a very smooth surface that is free of steps or rough edges. This eliminates the possibility of scraps of paper adhering to said outside wall or to the sealing strips.

The system according to the invention is used especially in the area between two drying cylinders of a single-tier drying section that uses a single supporting felt per drying group.

Of course, it is also possible to locate the drying system feature according to the invention at the end of the drying group, i.e. immediately after the last drying cylinder. In such an arrangement, after leaving the transfer roller, the supporting felt together with the paper web travels to a web transfer zone at which the paper web separates from the supporting felt and is transferred for example to the supporting felt of a following downstream, drying group.

Other features and advantages of the present invention will become apparent from the following description of the invention which refers to the accompanying drawings.

DETAILED DESCRIPTION OF EMBODIMENTS OF THE INVENTION

Figure 1:
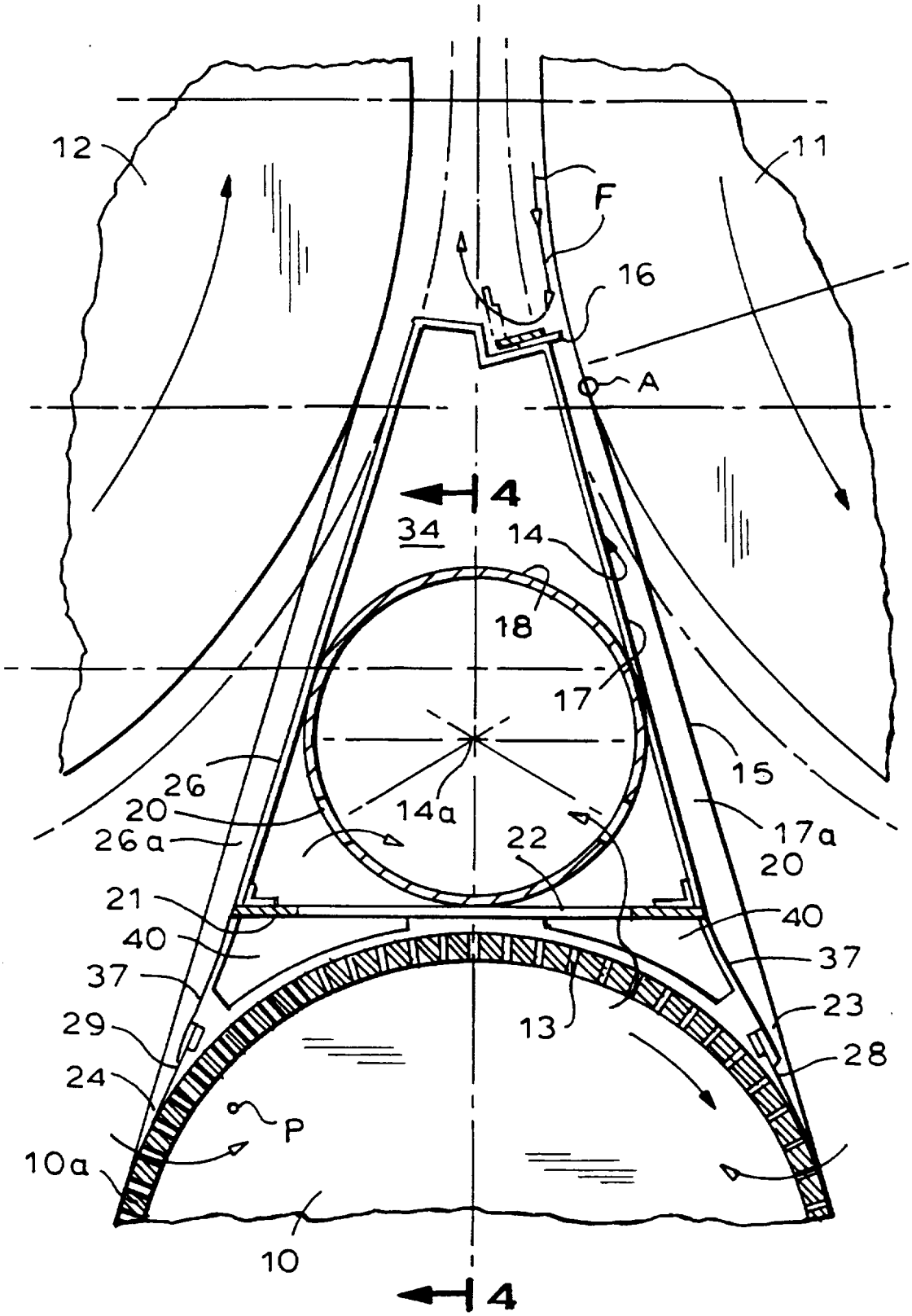
FIG. 1 is a cross section showing two drying cylinders with one transfer roller therebetween.

The Figures show variously two adjacent drying cylinders 11 and 12 and a transfer roller 10 located between and below the drying cylinders. The roller 10 has radially passing perforations, i.e. bores 13, in its roller mantel 10*a*. In addition, circumferential grooves can also be machined into the outer surface of the roller mantel. The grooves intersect with the bores 13.

A supporting felt 15 travels from the first drying cylinder 11 on a tangent straight path to the transfer roller 10 and from the roller 10 to the second drying cylinder 12.

Figure 2:
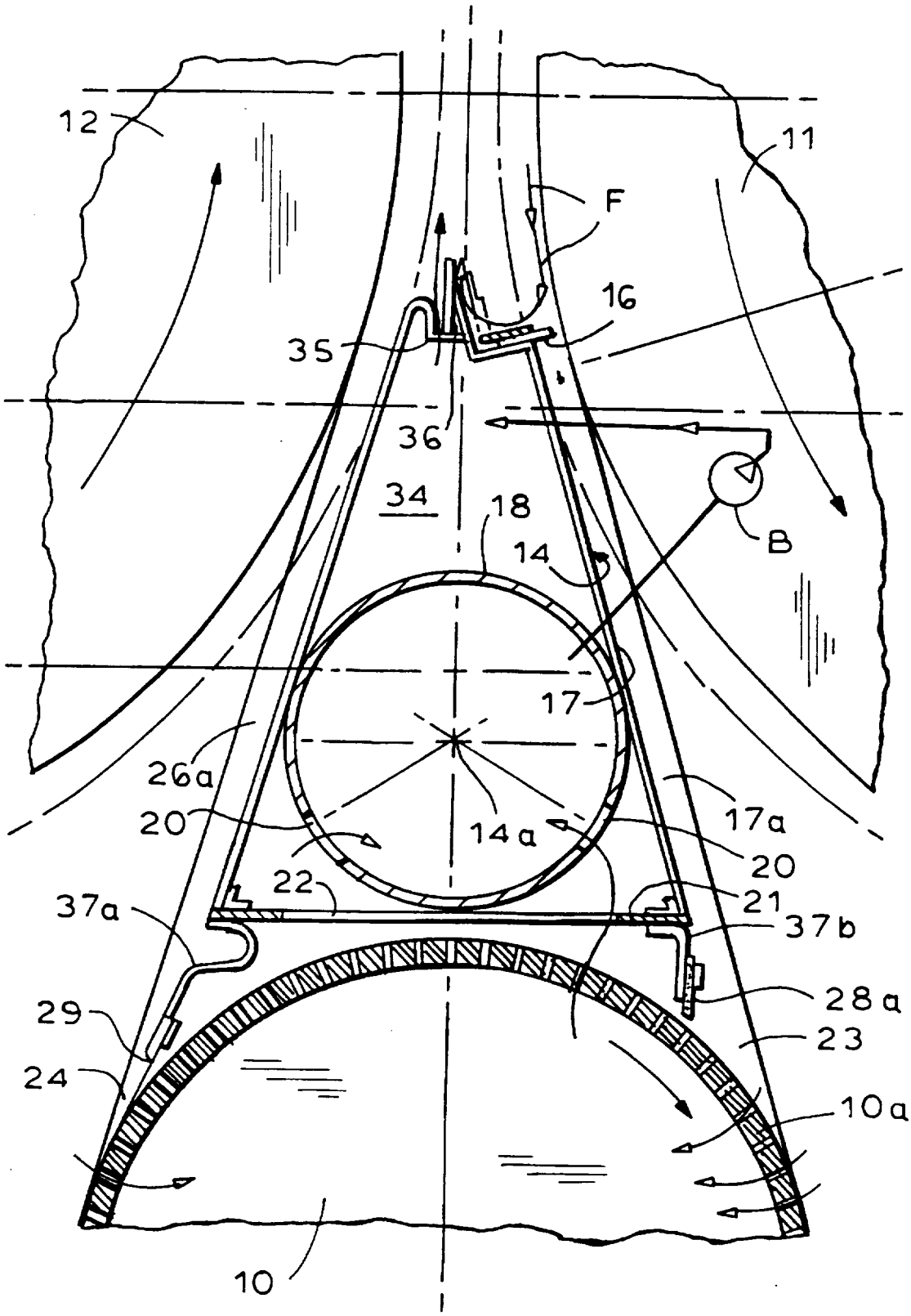
FIGS. 2 and 3 show variant embodiments that differ somewhat from the arrangement of FIG. 1.
Figure 3:
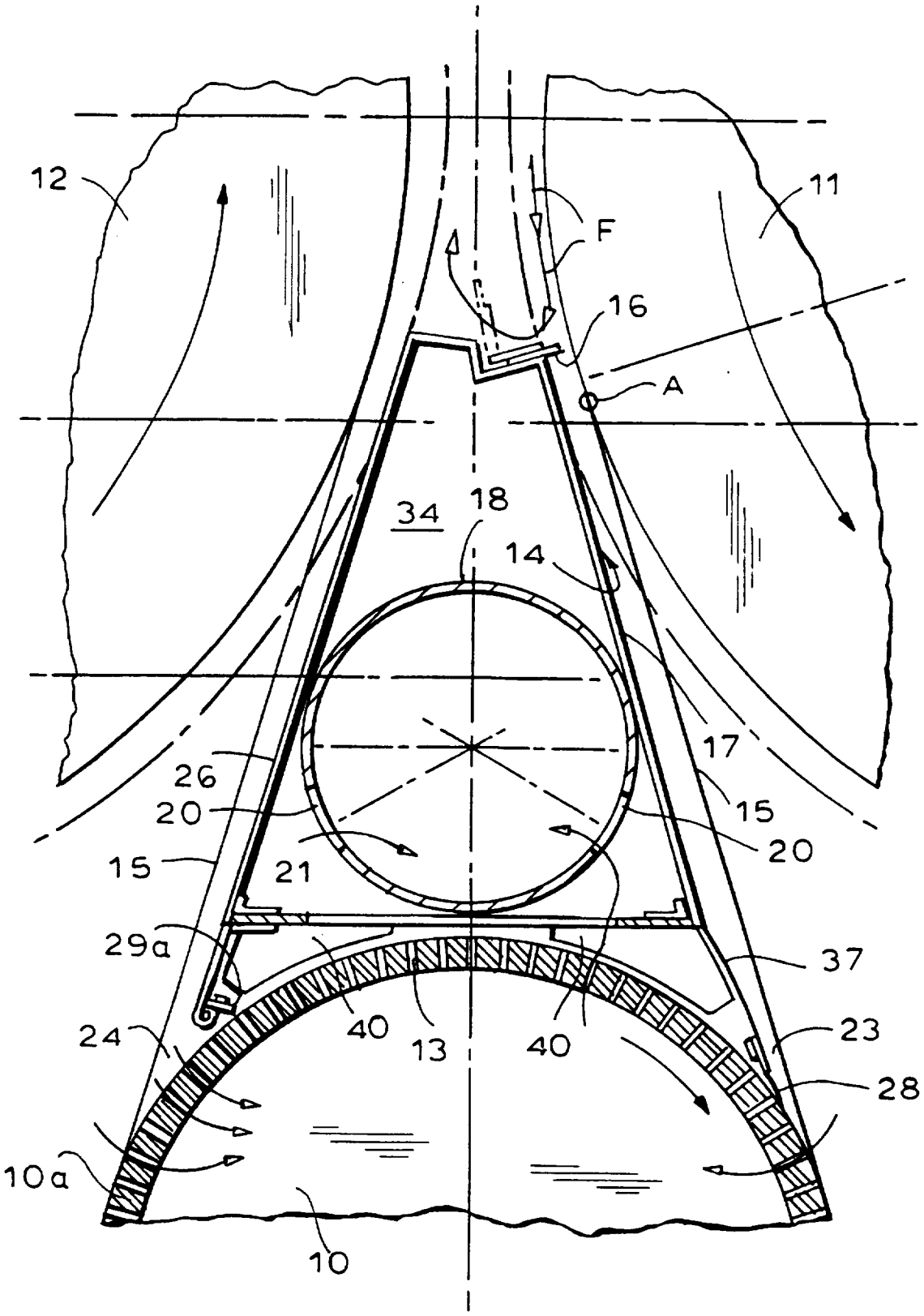

The paper web which is in constant contact with the outside surface of the supporting felt 15 and interrupted contact with the drying cylinders is not shown in FIGS. 1 to 3 for the sake of clarity.

To ensure that the paper web is reliably held in contact with the supporting felt 15 (even at high operating speeds, approximately 1,500 m/min), an external suction box 14 is provided adjacent those portions of the paper web runs where the paper web is not being pressed against the drying cylinders. This suction box is located in the pocket defined by cylinders 11 and 12, supporting felt 15, and transfer roller 10.

In the depicted embodiment, the bottom side of the paper web contacts the drying cylinders 11 and 12, while the top side of the paper web contacts the supporting felt 15. However, as is readily apparent a reverse arrangement is also contemplated in which the transfer roller 10 is located above the drying cylinders. Also, the drying cylinders 11 and 12 need not be oriented as shown, i.e. horizontally relative to each other. They can be disposed vertically or diagonally relative to one another.

Suction box 14 has a first outside wall 17 that extends along the path of supporting felt 15, generally from cylinder 11 to transfer roller 10.

A so-called trailing point A is defined in the drawings which is located at the point where the paper web and the supporting felt 15 leave the first cylinder 11. An air deflecting member 16 mounted in the upper 10 area of suction box 14, preferably a short distance before trailing point A, extends transversely to the web travel direction over the length of the suction box. It serves to deflect the air boundary layer entrained by the supporting felt 15. In FIGS. 1 to 3, the arrows F indicate air flow.

It is highly advantageous for air deflecting member 16 to be designed as a wiper strip, because in this way only mechanical means (wiper strip) needs to be used to deflect the air, to prevent its entry into the space between the box 14 and the felt 15. This expedient dispenses with the need to blow air in an opposite direction to deflect the air boundary layer, producing energy savings.

Only a small gap remains between the wiper strip and the felt. As a result most of the air boundary layer as mentioned above is deflected and thus prevented from continuing to flow in a direction toward the transfer roller 10.

FIGS. 1 to 3 show (by use of dot-dashed lines) that the air deflecting member 16 which is designed as a wiper strip is preferably pivotable. In the raised position (paper-making machine stopped), a new supporting felt can be fed through the larger opening thus formed. The member 16 can be made of plastic or felt material, for example.

In the lengthwise direction, an air intake duct 18 passes through suction box 14. The duct is preferably tubular. This duct extends at one or both of its two distal ends beyond the end wall 19 of suction box 14, as shown in FIG. 4.

Figure 4:
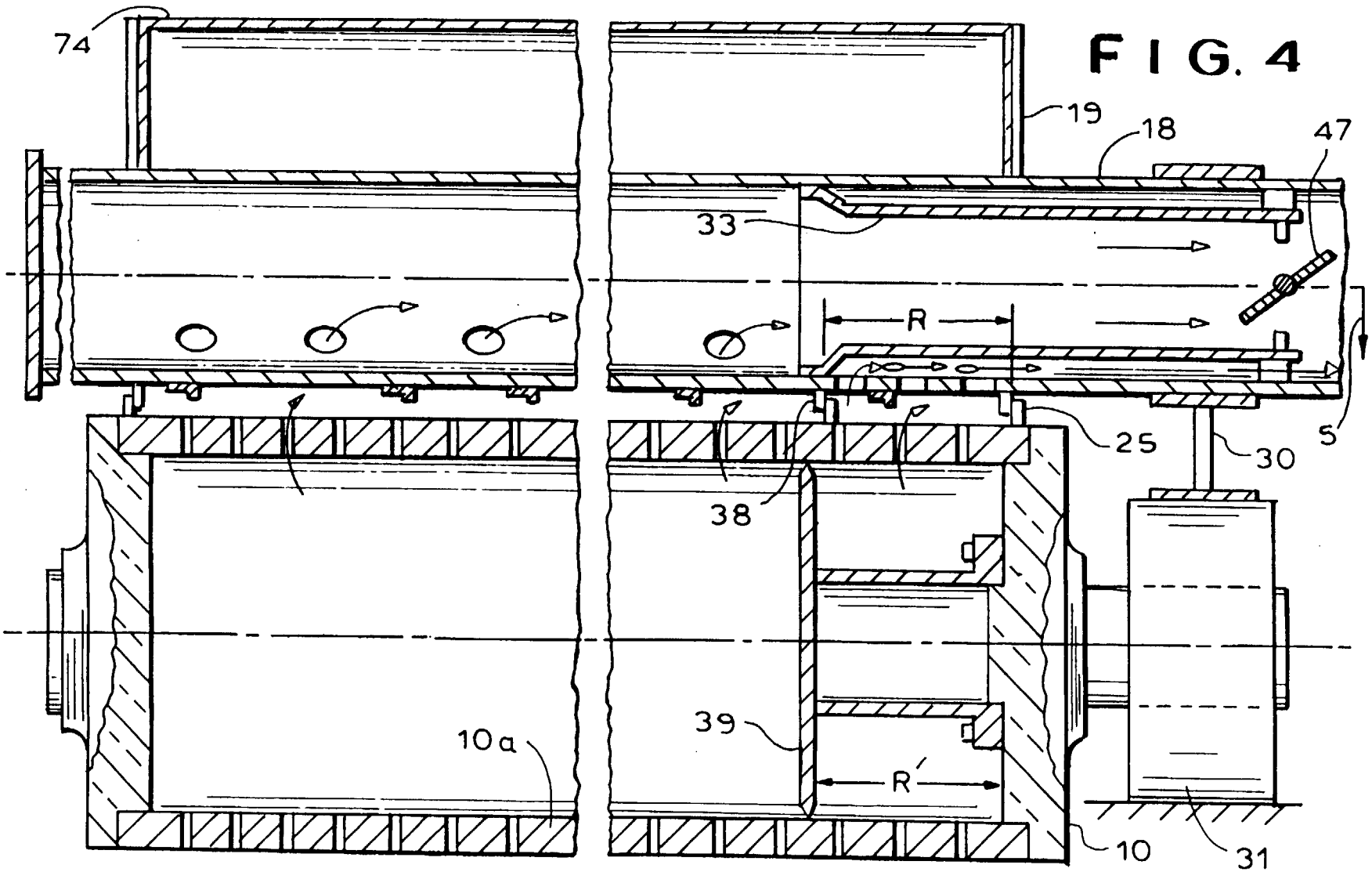
FIG. 4 depicts a further view of the system of FIG. 1 taken along line 4—4.

The duct 18 may be connected at this point to a suction blower (vacuum source), as indicated symbolically by an arrow S in FIG. 4. Air suction duct 18 has a plurality of suction openings 20 facing transfer roller 10. In FIG. 2 the suction blower is shown at B.

It is highly advantageous to include a concentrically disposed partition 33 (FIG. 4), preferably in the shape of a tubular duct, in the air intake duct 18, to create a special suction duct which draws air only from the end zone R indicated in FIG. 4. Suction is again produced by the above-mentioned suction blower that is depicted symbolically in FIG. 4.

Note that the air suction duct 18 also serves as the supporting element for the entire suction box 14. The air suction duct 18, also referred to at times here as the supporting tube, is received at and is held in a support 30 which is shown to be connected to the bearing housing 31 for the transfer roller 10 (FIG. 4)

The first outside wall 17 (FIG. 2) of the suction box 14 extends along the path of supporting felt 15, as mentioned above. The supporting felt and outside wall 17 are shown to be arranged approximately parallel to one another.

However, in order to prevent the paper web from initially continuing to travel along the mantel of cylinder 11 at the trailing point A, it is also possible to mount the first wall 17 slightly inclined relative to the supporting felt so that the supporting felt 15 and the first wall 17 diverge slightly from one another. This has the effect of creating a vacuum in the gap or space 17*a* between the supporting felt and the first wall 17 which further ensures that the paper web follows and remains in contact with the supporting felt 15 in this area.

The suction box 15 also has a second wall 26 which, like wall 17, can extend parallel to the felt 15 or, if desired, at a diverging angle relative to it.

Both walls 17 and 26 abut the support tube 18 tangentially, thereby defining an upper chamber 34. As indicated symbolically in FIG. 2, the air drawn from the interior of the suction box, especially the air that is drawn out of air suction duct 18, is blown by suction blower B into the upper chamber 34, causing it to flow outward through an air nozzle 35. This nozzle 35 is located in the vicinity of the web/felt trailing point, i.e. at the point where the joint run of the paper web and the supporting felt 15 reach the second drying cylinder 12.

Since the air blowing direction through air nozzle 35 is approximately tangent to the mantel of the second drying cylinder, the distribution and maintenance of a vacuum in the space 26*a* between the web/felt joint run and the box 14 is improved.

In order to control and maintain blowing direction, an air guide wall 36 is mounted at air nozzle 35, as shown in FIG. 2.

A lower outside wall 21 of suction box 14 is provided below the supporting tube, i.e. the air suction duct 18. Mounts 40 (FIG. 1) for additional lateral seals 25 shown in FIG. 4 (using felts for example) are provided below outside wall 21 to prevent ambient air from entering. In addition, end seals (made of felt for example) not shown in FIGS. 1 to 3 can be provided at outside wall 17, to provide sealing at the lateral ends of the space 17*a* between the felt 15 and wall 17.

Lower outside wall 21 extends along the free circumferential surface of transfer roller 10 and has a plurality of central openings 22 which face the perforations 13 in the roller 10. Thus, a vacuum is created through the perforations 13 inside the roller 10. This vacuum propagates through the bores 13 to the entire circumferential surface of the roller 10 that is covered by the supporting felt 15 and the paper web. By this vacuum, the paper web is drawn securely against the supporting felt 15 as it travels around the roller 10.

At the wedge-shaped region where the supporting felt 15 contacts the transfer roller 10, air is drawn into the roller 10 from the space 17*a* between the box 14 and felt 15 through the bores in the roller 10 that are located adjacent the leading gap 23. On the other side, where the supporting felt leaves the transfer roller 10 there is a similar trailing gap 24.

In the embodiment shown in FIG. 1, two lengthwise extending sealing strips 28 and 29 are mounted at the underside of suction box 14. Each of these sealing strips projects into a respective one of the above-mentioned gaps 23 and 24. That is, sealing strip 28 projects into the leading gap 23, and sealing strip 29 projects into trailing gap 24.

The sealing strips which are manufactured from plastic for example, and in the style of a doctor blade, are flexibly mounted by spring action to the suction box 14. Different from a doctor blade which serves to clean a roll shell in a known manner, sealing strips 28 and/or 29 extend approximately tangentially to roller mantel 10*a* and are pressed to it only very gently; the pressure should be approximately equal to zero.

It is evident from FIG. 1 that the two lengthwise sealing strips 28 and 29 are each held by means of a flat holder 37 (viewed in cross section) against suction box 14. (A somewhat differently shaped, arcuate holder 37*a* is depicted in FIG. 2.)

FIG. 2 further shows an angled bracket 37*b* that supports a conventional felt sealing strip 28*a* as explained below. The flat holders 37 are mounted to suction box 14 in a manner so as extend smoothly and continue with the surface of the adjoining outside wall 17 and/or 26. This has the significant advantage that no steps or edges are present and therefore no paper residue can accumulate there.

This smooth surface is at least approximately parallel to the essentially straight path that is traversed by the supporting felt 15. It may however also extend at a small angle relative to the felt 15.

Note the circumferential seals 25 that may also be provided on the end walls 19 of suction box 14 as shown in FIG. 4.

These seals are arranged at a very small distance from the mantel surface 10*a* of the transfer roller 10, so that the rotating roller mantel 10*a* can slide without braking, even while being in contact with these seals which are intended to prevent ambient air from being drawn in.

The suction box 14, if necessary, can be mounted to pivot about a pivot point P, in order to selectively space it slightly away from the first drying cylinder 11. Pivoting of the box 14, for example about point axis 14*a*, may be useful in the case where, for example, the doctor strip 16 cannot be raised, in order to facilitate the installation of a new supporting felt 15.

In addition, as shown in FIG. 4, suction box 14 can be provided at one of its two ends with a web tail threading zone. Thus, an end zone R defined by a partition 38 which can be connected temporarily to the 10 vacuum source alone may be provided. In addition, roller 10 also has a corresponding tail threading zone R' separated from the rest of the interior of the roller by a partition 39 that rotates together with roller mantel 10*a*. This zone is juxtaposed to the end zone R of the suction box mentioned above as shown in FIG. 4.

A baffle 41 is provided in the tubular duct 33, preferably in the area outside suction box 14 so that a drive for actuating the valve can be easily mounted on the outside of suction duct 18. If the valve is closed, only the tail threading zones R and R' are evacuated by being connected to the vacuum source.

In FIG. 2, only one doctor blade style, tangentially extending sealing strip 29 is provided at the trailing gap 24. In contrast, in the leading gap 23 a conventional felt sealing strip 28*a* is provided which (viewed in cross section) extends only very slightly, if at all, into the gap 23. This produces a slightly higher vacuum in the space 17*a* between outside wall 17 and the straight path of supporting felt 15 as compared to the embodiment of FIG. 1.

A reverse arrangement of that of FIG. 2 is shown in FIG. 3. Here the doctor blade like sealing strip 28 according to the invention is provided only at leading gap 23 while a conventional felt sealing strip 29*a* is provided at trailing gap 24.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A vacuum based system for guiding a paper web which travels together with a porous supporting felt through a drying section, the system comprising:

a) a first heatable drying cylinder, a transfer roller and a supporting felt for supporting the paper web between the drying cylinder and the transfer roller, the web and the supporting felt traversing an essentially straight path from the heatable drying cylinder to the transfer roller, the transfer roller being overlapped over a portion of its circumference by the supporting felt and by the web;

b) the transfer roller including a roller mantel and transfer roller vacuum means for establishing a vacuum at the roller mantel, an external suction box, located adjacent to a portion of the circumference of the transfer roller that is not overlapped by the supporting felt to induce a vacuum at the transfer roller vacuum means;

c) the suction box has a first outside wall extending along the straight path;

d) the suction box including at least one lengthwise extending sealing strip located transversely to the web travel direction and extending into a gap region defined by the roller mantel and the supporting felt at a region where the supporting felt meets the roller mantel, to direct a vacuum from the suction box toward the transfer roller; and e) the at least one lengthwise extending sealing strip being flexibly mounted on the suction box, and extending approximately tangentially to the roller mantel and being biased thereagainst.

2. The system according to claim 1, wherein the gap region includes a leading gap and a trailing gap and the at least one sealing strip includes a first doctor blade style sealing strip at the leading gap and a second doctor blade style sealing strip at the trailing gap.

3. The system according to claim 2, wherein each of the first and second sealing strips is mounted flexibly to only gently abut the roller mounted with a pressure that is approximately equal to 0.

4. The system according to claim 2, wherein at least one of the two sealing strips is mounted by means of a support including an arcuate portion mounted flexibly on the suction box.

5. The system according to claim 2, wherein at least one of the two sealing strips is mounted on a suction box by means of a support that is flat and provides a smooth surface which extends smoothly from the suction box.

6. The system according to claim 5, wherein the flat support extends smoothly from an adjoining outside wall of the suction box.

7. The system according to claim 5, wherein the flat support is flexibly mounted to bear gently against the transfer roller.

8. The system according to claim 6, wherein the flat support has a surface that extends approximately parallel to the straight path of the supporting felt or forms a small divergent angle therewith.

9. The system according to claim 1, wherein the suction box is movably mounted relative to the first drying cylinder to enable formation of an enlarged space between the suction box and the first drying cylinder.

10. The system according to claim 1, including a second drying cylinder for receiving the paper web and support felt from the transfer roller, the suction box including an air nozzle for directing air drawn by the suction box in a blowing direction that is approximately tangent to a mantel of the second drying cylinder at the vicinity of the air nozzle.

11. The system according to claim 10, wherein the air nozzle includes a guide wall for assisting the direction of the air from the air nozzle.

12. The system according to claim 1, wherein the suction box has a supporting tube that also serves as an air suction duct in which a partition is disposed to form two suction ducts.

13. The system according to claim 12, wherein the partition is tubular.

14. The system according to claim 1, including an air deflecting member extending transversely to the web travel direction over the length of the suction box and serving to deflect an air boundary layer entrained by the supporting felt.

15. The system according to claim 14, wherein the air deflecting member is designed as a wiper strip.

16. The system according to claim 15, wherein the wiper strip is movable a short distance away from supporting felt.

17. The system according to claim 16, wherein the wiper strip is pivotably mounted.

18. The system according to claim 1, in which the transfer roller vacuum means comprises through going perforations in the roller mantel.

19. The system according to claim 1, wherein the transfer roller vacuum means comprises circumferentially extending grooves formed in the roller mantel.

20. A drying section, including:

a first heatable drying cylinder, a transfer roller having a circumferentially extending mantel, a suction box disposed adjacent to the transfer roller for inducing a vacuum around the mantel of the transfer roller and a supporting felt extending along a straight path from the first heatable drying cylinder and the transfer roller;

a leading gap region defined along the circumferential surface of the transfer roller, adjacent to where the felt arrives and contacts the transfer roller, and a trailing gap region on the circumference of the mantel of the transfer roller located near where the supporting felt leaves the transfer roller;

at least one sealing strip extending from the suction box and contacting the transfer roller at one of said leading gap region and said trailing gap region, wherein the sealing strip extends substantially tangentially to the surface of the transfer roller.

21. The drying section of claim 20, wherein the transfer roller is a vacuum roll containing a plurality of through going perforations.

22. The drying section of claim 20, wherein the transfer roll mantel contains a plurality of circumferentially extending grooves.

23. The drying section of claim 20, wherein the suction box has a first outside wall extending substantially parallel to the path of the supporting felt in juxtaposition to the supporting felt.

24. The drying section of claim 20, wherein the at least one sealing strip is mounted flexibly to the suction box in a manner such that it is biased and bears resiliently against the mantel of the transfer roller.

25. The drying section of claim 20, wherein the at least one sealing strip includes a first sealing strip provided at the leading gap region and a second sealing strip located at the trailing gap region.

26. The drying section of claim 20, wherein the at least one sealing strip is provided at the leading gap region and including a conventional sealing strip provided at the trailing gap region.

27. The drying section of claim 20, wherein the at least one sealing strip is provided at the trailing gap region and including a conventional sealing strip provided at the leading gap region.

* * * * *